US009126409B2

(12) United States Patent
Tamenaga et al.

(10) Patent No.: US 9,126,409 B2
(45) Date of Patent: Sep. 8, 2015

(54) LIQUID DISCHARGE HEAD

(71) Applicant: CANON KABUSHIKI KAISHA, Tokyo (JP)

(72) Inventors: Zentaro Tamenaga, Sagamihara (JP); Shuzo Iwanaga, Kawasaki (JP); Kazuhiro Yamada, Yokohama (JP); Takuto Moriguchi, Kamakura (JP); Takatsugu Moriya, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/530,953

(22) Filed: Nov. 3, 2014

(65) Prior Publication Data

US 2015/0130875 A1 May 14, 2015

(51) Int. Cl.
*B41J 2/14* (2006.01)

(52) U.S. Cl.
CPC ..... *B41J 2/1433* (2013.01); *B41J 2002/14491* (2013.01)

(58) Field of Classification Search
None
See application file for complete search history.

(56) References Cited

U.S. PATENT DOCUMENTS 7,182,434 B2 2/2007 Silverbrook et al.
2010/0309257 A1* 12/2010 Goto ..... 347/50

* cited by examiner

*Primary Examiner* — Geoffrey Mruk
*Assistant Examiner* — Bradley Thies
(74) *Attorney, Agent, or Firm* — Fitzpatrick, Cella, Harper & Scinto

(57) ABSTRACT

A liquid discharge head includes a plurality of first support members, a second support member that is jointed to the first support members and is provided with openings, a plurality of printing element substrates that are each positioned in the opening and are jointed on the first support members to discharge liquid, and an electrical wiring substrate that is jointed on the second support member and is provided with wiring for applying electrical signals on each of printing elements of the plurality of printing element substrates, wherein a linear expansion coefficient of the second support member is lower than that of the electrical wiring substrate.

10 Claims, 6 Drawing Sheets

LIQUID DISCHARGE HEAD

BACKGROUND OF THE INVENTION

1. Field of the Invention

The present invention relates to a liquid discharge head that discharges liquids such as ink, and particularly to a liquid discharge head that is provided with a plurality of printing element substrates.

2. Description of the Related Art

An inkjet (IJ) printer discharges ink from a print head to a print medium for printing. High-speed printing is strongly required in the print head of the inkjet printer in business applications. There is a method in which a line head having a width longer than a width of a print medium is adopted as a print head to print by the width of the print medium as one of methods for realizing the high-speed printing.

In regard to the print head with the long width, U.S. Patent Laid-Open No. 2005/0162466 (U.S. Pat. No. 7,182,434) discloses the configuration in which a plurality of removable head modules is mounted on a single support member. Electrical wiring substrates each are fixed individually to the plurality of head modules.

SUMMARY OF THE INVENTION

However, in a case of providing the electrical wiring substrate individually to correspond to each of the printing element substrates in the liquid discharge head that is provided with the plurality of printing element substrates, the routing of wiring of a power source system is difficult and there is a possibility that a sufficient power source system cannot be ensured for high-speeding.

In contrast to this, in a case of providing a collective electrical wiring substrate common to the plurality of printing element substrates, the power source system can be ensured, but component members of the liquid discharge head are susceptible to linear expansion of the electrical wiring substrate by heating and cooling in the mounting process. That is, the heating causes a change in dimension of the electrical wiring substrate to generate a positional shift of a flow path member jointed to the electrical wiring substrate, resulting in degradation of positional accuracy between the printing element substrates that are mounted on the flow path member.

In the liquid discharge head where the plurality of printing element substrates are mounted, the accuracy of the mounting positions of the printing element substrates with respect to each other is important. When the accuracy of the mounting positions of the printing element substrates with respect to each other is low, accuracy in landing-in position of discharged ink liquid droplets on a print medium is also low to generate streaks, unevenness or the like on an image, leading to degradation of image quality. Therefore there is a demand for the liquid discharge head that is high in accuracy of the mounting positions of the printing element substrates with respect to each other.

Therefore the present invention has an object of providing a liquid discharge head that is excellent in accuracy in mounting positions of printing element substrates with respect to each other.

In order to solve the above problem, a liquid discharge head according to the present invention comprises a plurality of first support members, a second support member that is jointed to the first support members and is provided with openings, a plurality of printing element substrates that are each positioned within the opening and are jointed on the first support members to discharge liquid, and an electrical wiring substrate that is jointed on the second support member and is provided with wiring for applying an electrical signal to a printing element of each of the plurality of printing element substrates, wherein a linear expansion coefficient of the second support member is lower than that of the electrical wiring substrate.

According to the present invention, it is possible to provide a liquid discharge head that is excellent inaccuracy in mounting positions of printing element substrates with each other and is provided with a plurality of printing elements mounted thereon.

Further features of the present invention will become apparent from the following description of exemplary embodiments (with reference to the attached drawings).

DESCRIPTION OF THE EMBODIMENTS

Hereinafter, embodiments of the present invention will be explained in detail with reference to the drawings.

First Embodiment

An explanation will be made of a liquid discharge head according to a first embodiment of the present invention with reference to FIG. 1 to FIG. 5.

Figure 1:
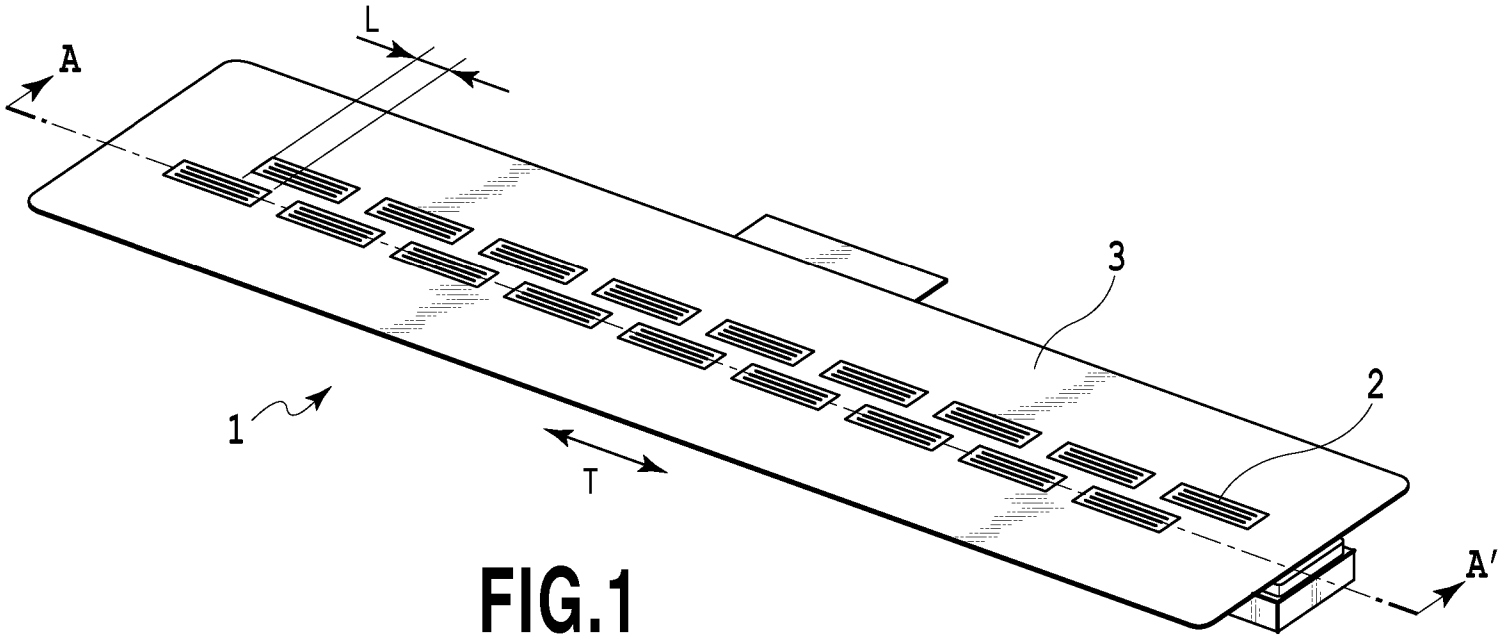
FIG. 1 is a schematic perspective view of a liquid discharge head according to an embodiment of the present invention.
Figure 2:
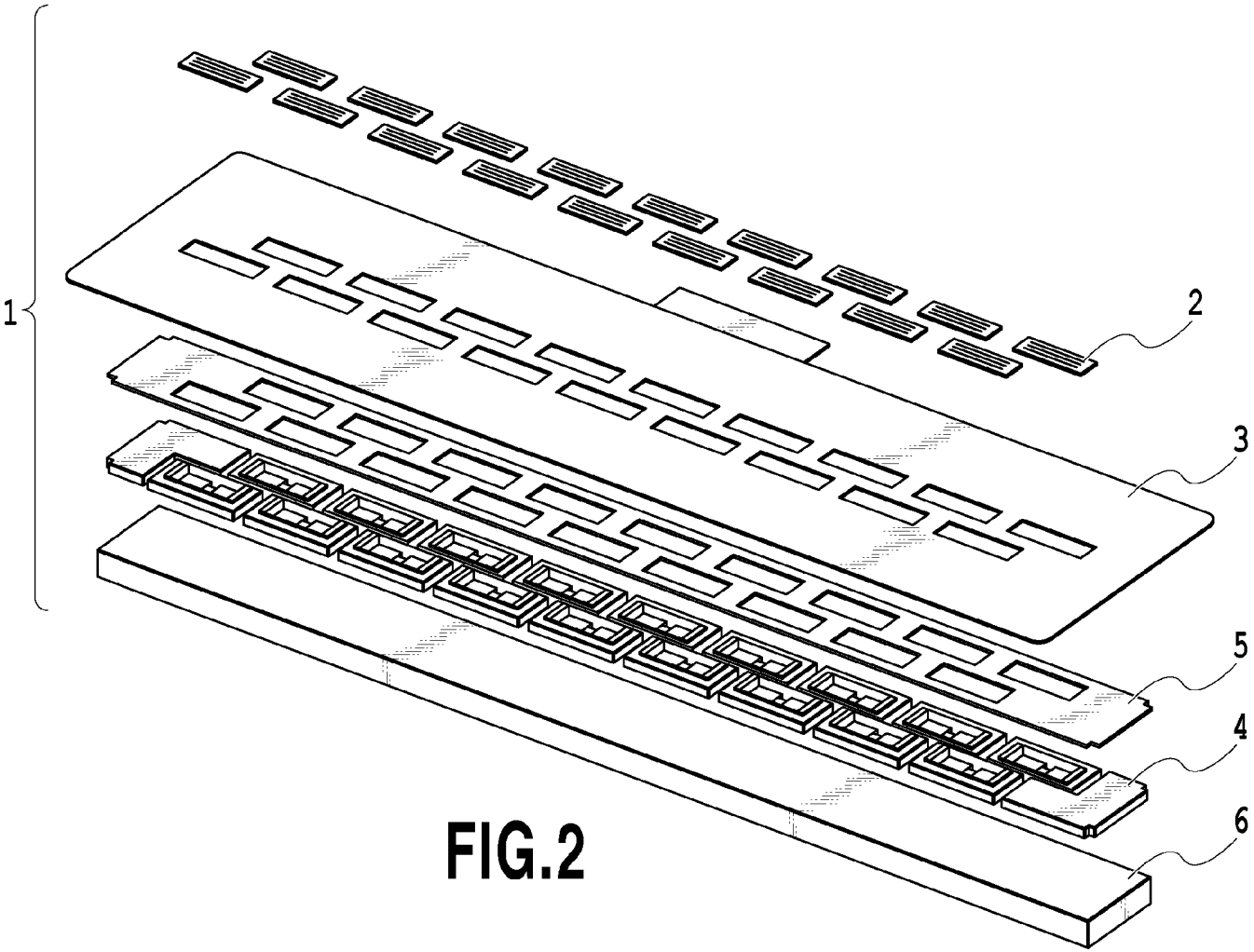
FIG. 2 is an exploded perspective view of a liquid discharge head according to a first embodiment of the present invention.

FIG. 1 is a schematic perspective view showing the liquid discharge head according to the first embodiment of the present invention. FIG. 2 is an exploded perspective view showing the liquid discharge head according to the first embodiment. A liquid discharge head 1 (hereinafter, also referred to as "head 1") in the present embodiment comprises printing element substrates 2, an electrical wiring substrate 3, support members (hereinafter, also referred to as "first support member") 4 for printing element substrate, a support member (hereinafter, also referred to as "second support member") 5 for electrical wiring substrate, and a support plate 6.

The support plate 6 is a member that is a base for supporting each component of the head 1 and is provided with a supply port (not shown) for supplying liquid to the printing element substrate 2 through the first support member 4. It is necessary for the support plate 6 to have a corrosion resistance to liquid such as ink to be discharged, and the support plate 6 is preferably low in linear expansion coefficient and high in rigidity in view of deformation that possibly affects positional accuracy of the printing element substrate 2. A material of the support plate 6 may include, for example, alumina or silicon carbide preferably. The plurality of first support members 4 are jointed on the support plate 6. A general adhesive in this technical field can be used for joint of each component in the head 1.

The first support member 4 acts as a support member that joints the printing element substrates 2 on an upper surface thereof for support, and is provided with a liquid flow path (not shown) communicated with a supply port of the support plate 6 and a discharge port of the printing element substrate 2 to act as a flow path forming member. The printing element substrates 2 and the second support member 5 are jointed on the upper surface of the first support member 4 (refer to FIG. 3A and FIG. 4A).

The printing element substrate 2 is provided with printing elements that generate energy for discharging liquid to discharge ink and the like, and is provided with discharge openings (not shown) corresponding to the printing elements. The printing element substrate 2 is provided with an electrode at the end for electrical connection to an outside, and discharges liquid from the discharge port in response to an electrical signal from an outside. The discharge ports are arrayed in a line shape. The plurality of printing element substrates 2 form a full line head 1 that can discharge liquid corresponding to the entire width of the print medium.

Referring to FIG. 1, the plurality of printing element substrates 2 are arrayed in two lines in a direction where the array direction of the discharge ports is positioned along a long side direction T of the head 1. At this time, the plurality of printing element substrates 2 are arrayed in a zigzag manner such that a printing element substrate 2 in one line is positioned between two adjacent printing element substrates 2 in the other line. In the direction T, some of the discharge ports near the end of the printing element substrate 2 in the one line and some of the discharge ports near the end of the printing element substrate 2 in the other line are arrayed to overlap in position, and therefore an overlapping area L is formed. A defect in regard to the liquid discharge due to more or less positional misalignment of the printing element substrate at the time of jointing the printing element substrates 2 on the first support member 4, a difference in discharge amount by variations between the printing element substrates 2, or the like can be corrected by the discharge ports in the overlapping area L. In an example in FIG. 1, the head 1 is provided with eighteen printing element substrates 2, and has a print width of approximately 12 inches as a whole. It is possible to further increase the print width by increasing the numbers of the first support members 4 and the printing element substrates 2.

The second support member 5 is provided with openings in accordance with positions and the number of the printing element substrates 2 that are mounted on the head 1. The second support member 5 is jointed on the first support members 4 to bridge over the plurality of first support members 4 such that the printing element substrate 2 is positioned within the opening. The second support member 5 is preferably jointed on a section that does not make contact with the liquid flow path. The electrical wiring substrate 3 is jointed on the second support member 5. In the present invention, the second support member 5 is made of a material having a lower linear expansion coefficient and a higher rigidity than the electrical wiring substrate 3. For example, an oxidized aluminum is preferably used as the material of the second support member 5.

The electrical wiring substrate 3 is provided with openings in accordance with positions and the number of the printing element substrates 2 that are mounted on the head 1. The electrical wiring substrate 3 is jointed on the second support member 5 such that the printing element substrate 2 is positioned within the opening. The electrical wiring substrate 3 is provided to apply an electrical drive signal to the printing element substrate 2 from an outside, and is therefore provided with an electrode terminal on the surface. The electrical terminal of the electrical wiring substrate 3 and the electrode of the printing element substrate 2 are electrically connected by a connecting member such as wire bonding. A general material in the technical filed of a flexible film or the like having flexibility can be used for the electrical wiring substrate 3.

Figure 3A:
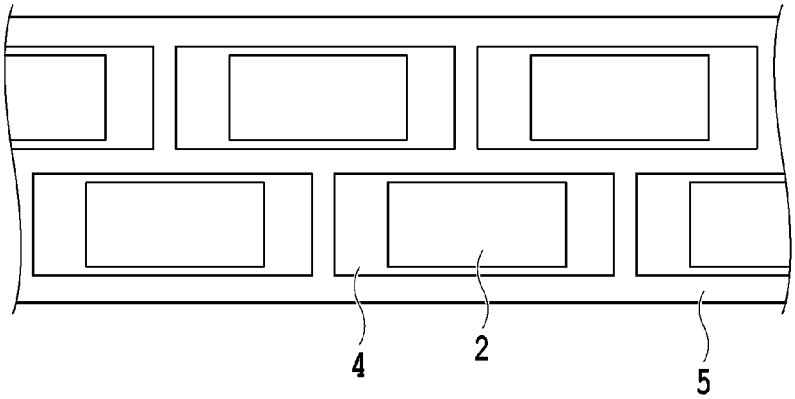
FIGS. 3A to 3C are diagrams each showing an upper surface in the vicinity of a printing element substrate, of the liquid discharge head according to the embodiment of the present invention.
Figure 3B:
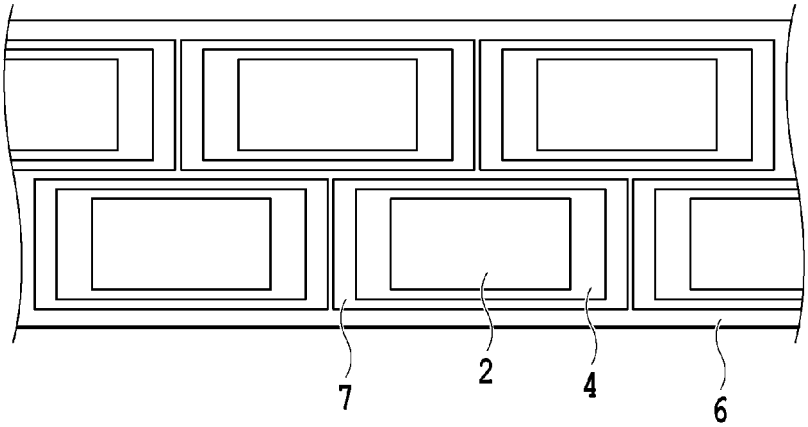

FIG. 3A is a diagram showing the upper surface of the liquid discharge head 1 according to the first embodiment, and shows a state before the electrical wiring substrate 3 is jointed. The second support member 5 is jointed on the first support member 4 such that a gap is formed between the printing element substrate 2 and the second support member 5.

Figure 3C:
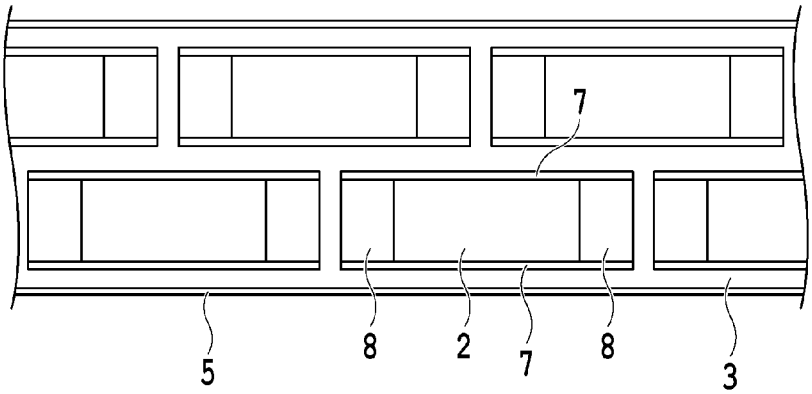
Figure 4A:
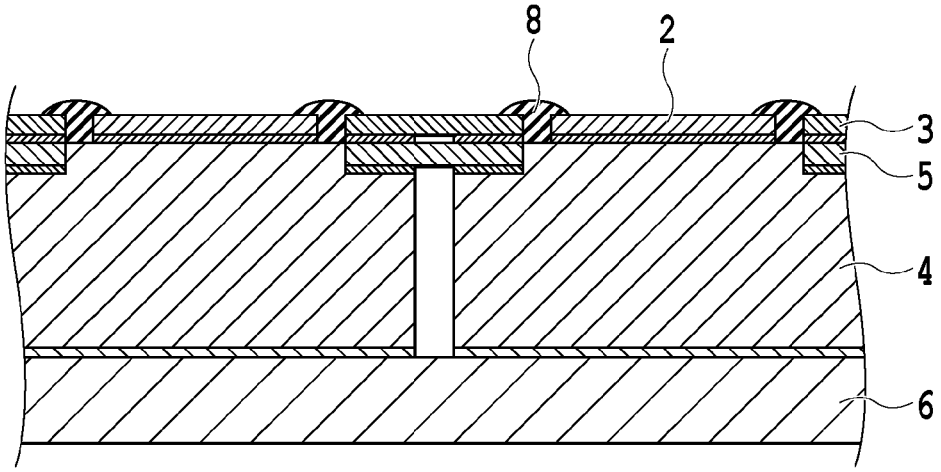
FIGS. 4A and 4B are sectional diagrams each showing apart of the liquid discharge head according to the embodiment of the present invention.

FIG. 3C is a diagram showing the upper surface of the liquid discharge head 1 according to the first embodiment, and FIG. 4A shows a part of a cross section of the head 1 taken along lines A-A' in FIG. 1. A first resin agent 7 is arranged in the gap between the second support member 5 and the printing element substrate 2. In addition, a second resin agent 8 is arranged in an electrical connection portion between the electrode terminal of the electrical wiring substrate 3 and the electrode of the printing element substrate 2 through coating and heat hardening. The first resin agent 7 and the second resin agent 8 of the present embodiment each is made of thermosetting epoxy resin. The first resin agent 7 and the second resin agent 8 are provided for mechanical protection against outside forces, chemical protection against corrosion by liquid and the like. The first resin agent 7 and the second resin agent 8 may be made of the same material or different materials depending upon the purpose. A material made of resin having a high flexibility coefficient is preferably used for the second resin agent such that the connecting member, the electrode and the electrode terminal can be protected from outside forces by wiping or the like at use.

Second Embodiment

Figure 4B:
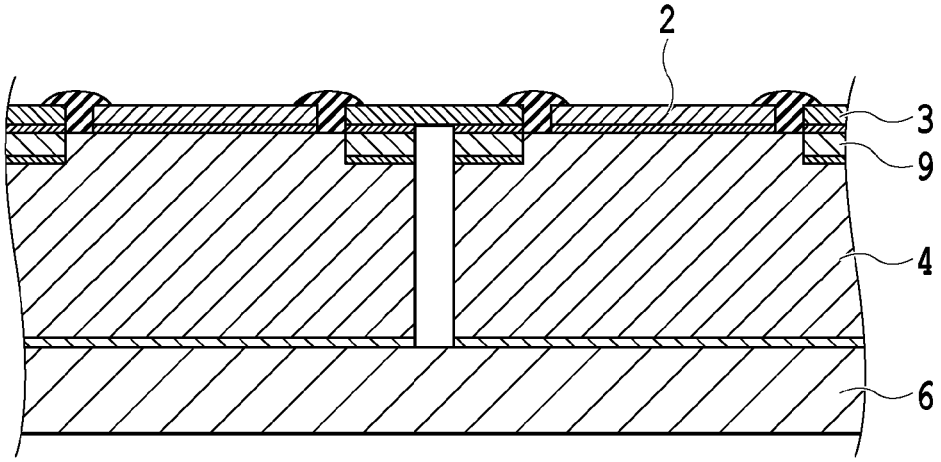
Figure 5:
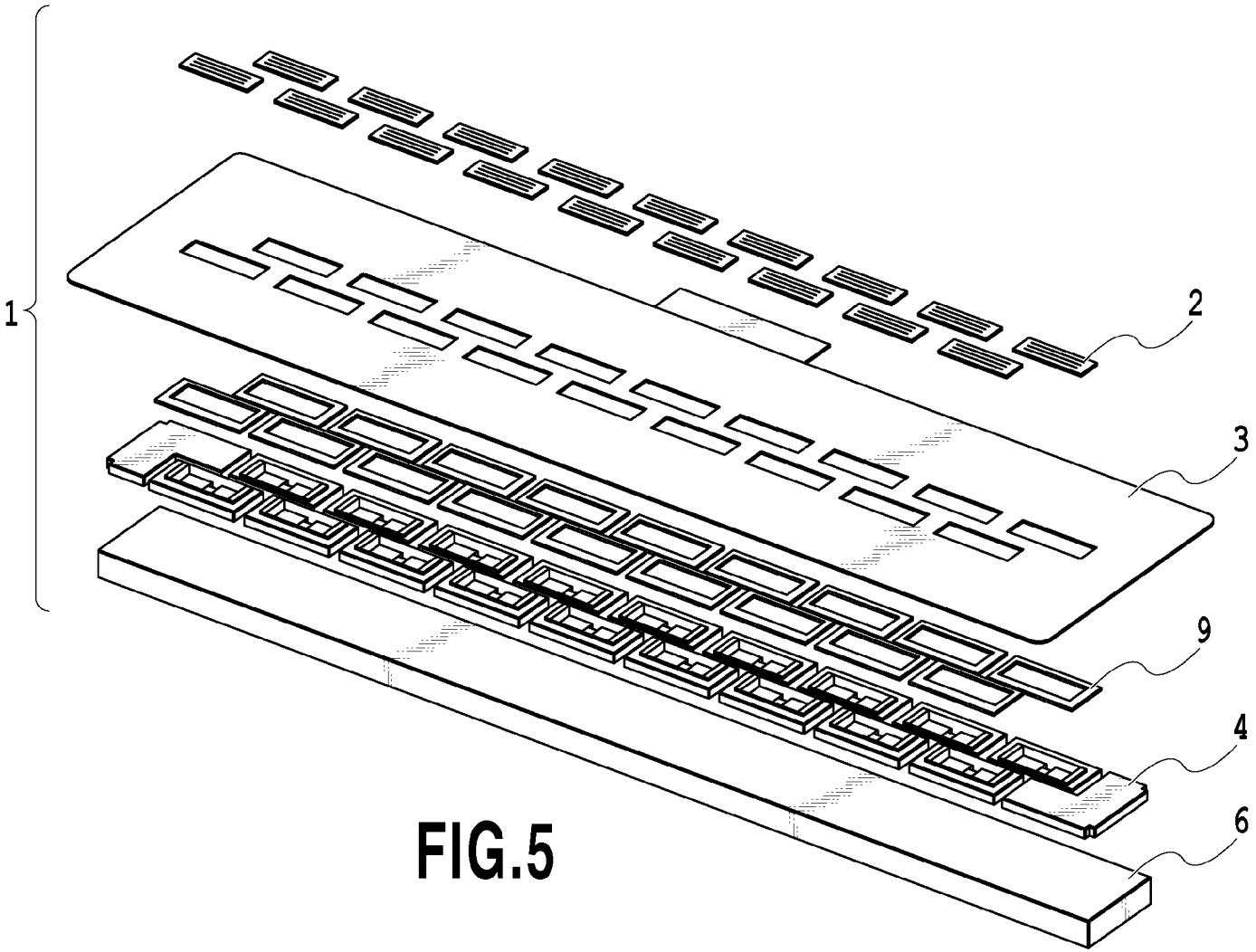
FIG. 5 is an exploded perspective view of a liquid discharge head according to a second embodiment of the present invention.

An explanation will be made of a second embodiment of the present invention with reference to FIG. 4A, FIG. 4B and FIG. 5.

A liquid discharge head according to the second embodiment has an outside appearance as shown in FIG. 1 to be similar to the liquid discharge head according to the first embodiment. FIG. 4B shows a part of a cross section of the liquid discharge head in the second embodiment taken along lines corresponding to lines A-A' in FIG. 1. FIG. 5 is an exploded perspective view of the liquid discharge head in the second embodiment. Components in the second embodiment identical to those in the first embodiment are referred to with identical signs in the figures, and an explanation of components in common is omitted.

The second embodiment differs from the first embodiment in the configuration of a second support member that is a member for supporting the electrical wiring substrate 3. In detail, the second support member 5 in the first embodiment is, as shown in FIG. 2 and FIG. 4A, a member that has openings corresponding to the plurality of printing element substrates 4 collectively. In contrast to this, second support members 9 in the second embodiment are, as shown in FIG. 5 and FIG. 4B, a member each of which has an opening corresponding to each of a plurality of printing element substrates 4, and the plurality of second support members 9 are provided in the head 1. Each of the second support members 9 is jointed on the first support member 4 such that the printing element substrate 2 is positioned within the opening. An electrical wiring substrate 3 is jointed on the second support members 9. In this example, the number of the second support members 9 is equal to each number of the printing element substrates 2 and the first printing element substrates 4. In the present invention, the second support member 9 is made of a material having a lower linear expansion coefficient and a higher rigidity than the electrical wiring substrate 3.

Effects of the Invention

An explanation will be made of effects of the present invention with reference to a reference example.

Reference Example

Figure 6:
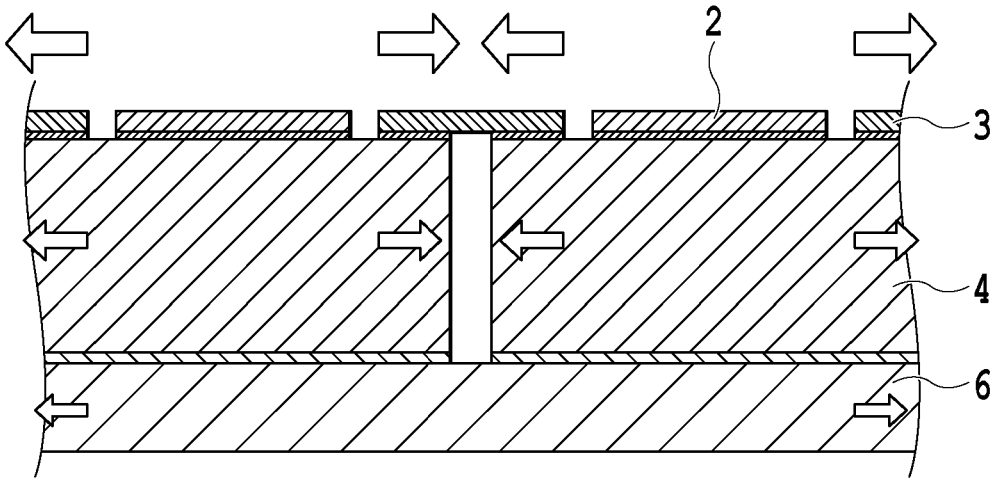
FIG. 6 is a sectional diagram of a part of a liquid discharge head according to a comparative example.

An explanation will be made of a liquid discharge head in the reference example. The liquid discharge head according to the reference example has an outside appearance as shown in FIG. 1 to be similar to the liquid discharge head according to the first embodiment. FIG. 6 shows a part of a cross section of the liquid discharge head in the reference example taken along lines corresponding to lines A-A' in FIG. 1. Components in the reference example identical to those in the first embodiment are referred to as identical signs in the figures, and an explanation of components in common is omitted. The liquid discharge head in the reference example differs from the configuration of each of the first embodiment and the second embodiment in a point where the second support member that supports the electrical wiring substrate 3 is not provided. That is, in the liquid discharge head in the reference example, the electrical wiring substrate 3 is jointed directly on the first support member 4 not through the second support member 5 or 9.

[Test Method]

The liquid discharge heads of the first embodiment, the second embodiment and the reference example, which each had the abovementioned configuration, were manufactured, and were respectively referred to as Example 1, Example 2 and Reference Example. The sample number was three for each of Examples. A transfer amount from an initial mounting position (reference position 0) to a final mounting position of the printing element substrate of each of the components in the mounting process was measured to evaluate positional accuracy thereof.

Materials of the respective components used in manufacturing the respective liquid discharge heads, kinds and application amounts, conditions of heat treatment of the adhesive agents used for adhesion of the respective components, and the like were all set to be the same. As to linear expansion coefficients of the respective components, approximately 16 ppm was in the electrical wiring substrate 3, approximately 15 ppm was in the first support member, and approximately 7 ppm was in the support plate 6. Focusing on the longitudinal direction (direction T in FIG. 1) of the head in which a positional change is remarkable, the transfer amount of each of only six printing element substrates in the longitudinal direction of the head was measured. The maximum transfer amount and variations (standard deviations) in the transfer amount were found from the measurement value of each of the three samples. A first table shows the result.

[Result and Review]

TABLE 1

| Sample | Maximum transfer amount (μm) | Variations in transfer amount (μm) |
|---|---|---|
| Example 1 | 3.64 | 2.49 |
| Example 2 | 2.97 | 3.89 |
| Reference Example | 5.67 | 6.11 |

From Table 1, in Reference Example it is understood that the final mounting position of the printing element substrate was transferred by approximately 5.7 μm at the maximum from the initial mounting position. On the other hand, the maximum transfer amount of the present invention was 3.6 μm in Example 1 and 3.0 μm in Example 2. That is, according to the embodiment of the present invention, it is found out that the maximum transfer amount can be suppressed more than the reference example.

Here, even if the transfer amount of the printing element substrate is large, when the variation for each head is small and the printing element substrate transfers by the same degree and in the same direction, it is possible to overcome the problem due to the transfer by beforehand correcting the initial mounting position of the printing element substrate based upon the transfer amount and the transfer direction. However, as shown in Table 1, the variation also resulted in being large in Reference Example. When such a variation occurs, it is difficult to beforehand correct the initial mounting position appropriately. On the other hand, the variation is small in Example 1 and Example 2. Therefore, it is possible to bring the final mounting position closer to the original desired position by mounting the printing element substrate based upon the beforehand correction of the initial mounting position by prediction of the transfer. That is, according to the embodiment of the present invention, in the line head where the plurality of printing element substrates are arranged in a line, it is possible to ensure excellent relative positional accuracy between the printing element substrates.

Review will be made of the effects of the present invention as described above in view of the configurations. In the mounting process of each component at the time of manufacturing the liquid discharge head having each configuration as described above, heat treatment is performed for heat-hardening resin agents at the arrangement of the first resin agent and at the arrangement of the second resin agent. In the process where components reach high temperatures by heating and thereafter, are cooled to room temperatures, each component is subjected to an influence by a difference in linear expansion coefficient therebetween.

The configurations of the liquid discharge heads according to the embodiments of the present invention differ from that of the liquid discharge head in Reference Example in a point of presence/absence of the second support member. In Reference Example without the second support member, as shown in FIG. 6, the electrical wiring substrate 3 expands/contracts by heat, and the first support member 4 jointed thereto is deformed subjected to an influence of tension and compression. Following this, the printing element substrate 2 that is jointed on the first support member 4 transfers from the originally desired position (normal position).

On the other hand, in the liquid discharge head according to the first embodiment (Embodiment 1), the electrical wiring substrate 3 is jointed indirectly to the first support member 4 through the second support member 5. Since the second support member 5 is lower in linear expansion coefficient than the electrical wiring substrate 3, deformation by heat of the electrical wiring substrate 3 can be restricted by the second support member. Accordingly the deformation of the first support member 4 that is jointed to the second support member 5 is more suppressed as compared to a case where the second support member 5 is not present. As a result, the transfer of the printing element substrate 4 from the normal position is suppressed. Since the liquid discharge head according to the second embodiment also has the second support member similarly, the above review on the first embodiment can be applied thereto.

In this way, according to the configuration of the present invention, the positional accuracy between the printing element substrates that are mounted on the liquid discharge head can be appropriately maintained.

The second embodiment has the following advantages in addition to the effect of the first embodiment of the present invention by using the second support member that differs in the configuration from the first embodiment. That is, the second support member 9 in the second embodiment is easier in manufacturing, lower in costs, and can be jointed to the first support member 4 with higher accuracy as compared to the longer second support member 5 in the first embodiment.

It should be noted that when the second support member is flatly jointed on the upper surface of the first support member 4, capping properties at the time of covering the discharge surface of the head in a recovery operation for recovering the liquid discharge function of the liquid discharge head can be also ensured. For example, the configuration where the joint surface between the first support member and the printing element substrate and the joint surface between the second support member and the electrical wiring substrate are positioned to be on a substantially same plane as shown in FIG. 4A or 4B is preferable for ensuring the capping properties.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-233210, filed Nov. 11, 2013, which is hereby incorporated by reference herein in its entirety.

What is claimed is:

1. A liquid discharge head comprising:

a plurality of first support members;

a second support member that is jointed to the first support members and is provided with openings;

a plurality of printing element substrates that are each positioned within the opening and are jointed on the first support members to discharge liquid; and an electrical wiring substrate that is jointed on the second support member and is provided with wiring for applying electrical signals to each of printing elements of the plurality of printing element substrates, wherein a linear expansion coefficient of the second support member is lower than a linear expansion coefficient of the electrical wiring substrate.

2. The liquid discharge head according to claim 1, wherein the second support member is jointed to the plurality of first support members to bridge thereover.

3. The liquid discharge head according to claim 1, comprising a plurality of the second support members, wherein each of the plurality of second support members is jointed to one of the plurality of first support members.

4. The liquid discharge head according to claim 1, wherein the electrical wiring substrate includes openings, and is jointed on the second support member such that one of the printing element substrates is positioned within each of the openings.

5. The liquid discharge head according to claim 1, wherein the printing element substrate is positioned to avoid contact with the second support member and the electrical wiring substrate.

6. The liquid discharge head according to claim 1, wherein a joint surface between the first support members and the printing element substrates and a joint surface between the second support member and the electrical wiring substrate are positioned within a substantially same plane.

7. The liquid discharge head according to claim 1, wherein the second support member has rigidity higher than the electrical wiring substrate.

8. The liquid discharge head according to claim 1, wherein a connecting member for electrical connection is arranged between the electrical wiring substrate and the printing element substrates.

9. The liquid discharge head according to claim 1, wherein a resin agent for mechanically or chemically protecting the liquid discharge head is arranged in at least one of between the electrical wiring substrate and the printing element substrates and between the second support member and the printing element substrates.

10. The liquid discharge head according to claim 1, wherein the plurality of first support members are jointed to a support plate in common.

* * * * *